US008631950B2

(12) United States Patent
Whelan et al.

(10) Patent No.: US 8,631,950 B2
(45) Date of Patent: Jan. 21, 2014

(54) TEST TUBE MANAGEMENT DEVICE

(75) Inventors: Chris Whelan, Clovelly (AU); Craig Andrew Burke, Cremorne (AU)

(73) Assignee: Noble House Group Pty. Ltd. (AU)

( * ) Notice: Subject to any disclaimer, the term of this patent is extended or adjusted under 35 U.S.C. 154(b) by 146 days.

(21) Appl. No.: 12/867,554

(22) PCT Filed: Feb. 13, 2009

(86) PCT No.: PCT/AU2009/000172

§ 371 (c)(1),
(2), (4) Date: Aug. 18, 2010

(87) PCT Pub. No.: WO2009/100499

PCT Pub. Date: Aug. 20, 2009

(65) Prior Publication Data

US 2010/0314344 A1 Dec. 16, 2010

(30) Foreign Application Priority Data

Feb. 13, 2008 (AU) ..... 2008900760
Oct. 2, 2008 (AU) ..... 2008905144

(51) Int. Cl.
*A47F 5/08* (2006.01)
*A47G 29/00* (2006.01)
*B01L 9/06* (2006.01)

(52) U.S. Cl.
USPC ..... 211/85.18; 211/85.13; 211/113

(58) Field of Classification Search
USPC ..... 211/85.18, 113, 85.13; 248/68.1, 74.3; 224/249, 148.4, 251, 931, 918; 206/3, 206/142, 148, 155, 157, 174; 24/16 PB, 24/288; 422/102
See application file for complete search history.

(56) References Cited

U.S. PATENT DOCUMENTS

| | | | | | |
|---|---|---|---|---|---|
| 2,112,339 | A * | 3/1938 | Kasparek | 224/249 |
| 3,059,645 | A * | 10/1962 | Hasbrouck et al. | 604/179 |
| 3,334,794 | A * | 8/1967 | Saari et al. | 224/150 |
| 3,830,415 | A * | 8/1974 | Jacobson et al. | 224/230 |
| 3,895,718 | A * | 7/1975 | Seiller | 211/85.1 |
| 3,917,135 | A * | 11/1975 | Christensen | 224/682 |
| 4,662,873 | A * | 5/1987 | Lash et al. | 604/179 |
| 4,969,894 | A * | 11/1990 | Hempstead-Harris | 606/234 |
| 5,240,120 | A * | 8/1993 | McDonough | 211/85.2 |
| 5,632,427 | A * | 5/1997 | Gattuso et al. | 224/309 |
| 5,799,376 | A * | 9/1998 | Harsley | 24/16 PB |
| 5,906,033 | A * | 5/1999 | Mukaiyama | 24/589.1 |
| 6,313,406 | B1 * | 11/2001 | Gretz | 174/72 A |
| 6,341,382 | B1 * | 1/2002 | Ryvin et al. | 2/417 |
| 7,404,238 | B2 * | 7/2008 | McNeill | 24/16 PB |
| 2004/0262250 | A1 * | 12/2004 | Kosir | 211/113 |
| 2005/0006329 | A1 * | 1/2005 | Williquette | 211/113 |
| 2006/0289375 | A1 * | 12/2006 | Haschke | 211/113 |
| 2007/0175841 | A1 * | 8/2007 | Lyon et al. | 211/74 |

* cited by examiner

*Primary Examiner* — Jennifer E Novosad
(74) *Attorney, Agent, or Firm* — Galbreath Law Offices, P.C.; John A. Galbreath

(57) ABSTRACT

A sample tube holder (10) having a generally flat elongate flexible body (12) and one or more of sets of non circular apertures (16) each having a length dimension and a width dimension perpendicular to the length dimension, in the body, each set having two or more apertures (16) arranged in a line such that each set of apertures defines at least one inner portion (30) between adjacent apertures (16) of the set and at least one outer portion (32) adjacent each aperture at the end of the line extending away from the respective inner portion.

15 Claims, 11 Drawing Sheets

TEST TUBE MANAGEMENT DEVICE

FIELD OF INVENTION

This invention relates to holders for sample tubes and more particularly to holders for sample tubes that are collected when blood is taken from a donor. Blood may also mean blood components. The invention is also applicable to pathology when blood may be taken for testing patients rather than donors.

BACKGROUND

When blood is collected for blood donation from a human donor, the blood is collected in a flexible plastics bag. Part of the donated blood is also collected in a number of separate sample tubes. The purpose of these separate samples is to enable various tests for blood typing and blood borne diseases or defects to be carried out separately from the blood in the main collection bag.

The main collection bag, any satellite bags and all associated samples are labelled with the same unique identifier so that the various items of blood may traced when they are separated and samples tested in due course. Typically these tests and processes are carried out away from the location where the blood is donated and collected. This may be in a separate part of the same building or may be in a different building totally.

Existing blood and blood component collection containers do not provide a way to securely keep the sample tubes together and retained with the bag. Further, whilst methods exist to hold sample tubes prior and after use, there are no systems that are usable throughout the collection process, inclusive of before and after collection, during collection and during transport to the final destination.

When the blood is collected, the separate sample tubes may be gathered by use of one or more rubber bands or the like, both to keep the sample tubes together and to attach the tubes to the bag. Some bags have peripheral walls with slots into which sample tubes may be inserted as an alternative. The problem with use of such methods to attach the sample tubes to the bag is that they are not very secure. Whilst each sample tube is labelled with a unique identifier that associates the blood sample with the main blood collection, it remains preferable if all sample tubes and the bag are additionally kept together during the collection process in order to prevent misplacement, mix-up or other loss. With current methods, sample tubes may become separated from the respective bag. Collecting loose sample tubes is time consuming. There also exists the risk that one or more sample tubes may be dropped or broken when attaching them to, or removing them from, the bag or rubber band. If a sample tube breaks, this may cause problems with contamination and completion of required blood tests.

Further, generally, when taking the blood samples, there is nowhere to store or hold each tube after it has been filled with blood whilst another tube is being filled. Systems have been proposed that use wrist straps or "bum bags" to hold sample tubes before and after filling. However, these do not provide a solution to the need to securely keep the sample tubes together or to retain the sample tubes with the collection bag to prevent sample tube mix-up, and are not practicable when a user may collect blood from many different donors during the day.

Once blood is collected, there may exist a need to agitate a portion of the sample tubes, while not agitating the balance. Current methods of keeping sample tubes together using rubber bands, or inserting sample tubes into peripheral slots on the bags, do not facilitate easy agitation of individual sample tubes. Post-collection, the bags and sample tubes may be separated or may be together and placed in a large cooled or refrigerated container for transport to another location, where the bags and sample tubes are processed.

The above problems relating to maintaining sample tubes together are also applicable to pathology, where blood is also collected in sample tubes from a patient for pathology purposes, rather than for blood donation purposes. There is a need to easily retain pathology sample tubes together, whether during one or more of the collection, transport or subsequent processing stages.

SUMMARY OF THE INVENTION

Providing an enhanced means over existing methods by overcoming noted disadvantages, the invention provides a sample tube management system. The invention incorporates a generally flat elongate flexible body having one or more of sets of apertures or slits (hereinafter referred to as apertures) in the body. Each set has two or more apertures arranged in a line. Each set of apertures defines at least one inner portion between adjacent apertures of the set and at least one outer portion adjacent each aperture at the end of the line extending away from the respective inner portion. In use, a sample tube is passed through the apertures so that the at least one of the inner portion lies to one side of the sample tube and adjacent portions lie on the other side of the sample tube, thereby sandwiching the sample tube between the portions.

There may be two apertures for each set, thus defining a single inner portion. There may be three or more apertures for each set, in which case there will be multiple inner portions.

In one preferred form the invention incorporates a generally flat elongate flexible body having one or more of pairs of apertures in the body. Each pair of apertures defines a central portion there-between and an outer portion between each of the apertures and an edge of the body. In use, a sample tube is passed through the apertures so that the central portion lies to one side of the sample tube and the outer portions lie on the other side of the sample tube, thereby sandwiching the sample tube between the central portion and the outer portions.

The apertures are sized so that, in conjunction with the flexibility and resilience to the material of the holder, each sample tube is resiliently held and unintended movement of the sample tube through the apertures is substantially prevented.

In the preferred form of the invention, the holder has a generally elongate or rectangular retaining portion in which the apertures are located.

In the preferred form of the invention, the sets of apertures are arranged so sample tube(s) extend sideways across the retaining portion. Where multiple tubes are retained, preferably they are arranged in parallel to each other across the retaining portion but spaced along the retaining portion. Alternatively, the tubes may extend along the retaining portion.

In one form of the invention, each aperture is a segment of a circle, with the outer edge of each aperture generally parallel to a long side of the retaining portion. Other shapes or configuration of the apertures may be used and the apertures may be a simple slit in the material of the holder. Such slits may be straight, curved or other shaped line or cut-out.

The entire perimeter of each apertures may be curved and the apertures may be circular or non circular. Having an open passageway in the material for each aperture, as opposed to a slit in the material, aids in insertion of a sample tube into the aperture and through the material.

It has also been found that providing a non circular opening in the material aids in retention of sample tubes having a greater range of diameters compared to use of circular openings in the same material. More particularly, it has been found that a circular opening is only able to hold a particular diameter sample tube (or a relatively narrow range of diameters) whilst a non circular opening is able to hold sample tubes having a variety of diameters (or a broader range of diameters).

Accordingly in another broad form the invention provides a sample tube holder having a generally flat elongate flexible body and:

one or more of sets of non circular apertures each having a length dimension and a width dimension perpendicular to the length dimension, in the body, each set having two or more apertures arranged in a line such that each set of apertures defines at least one inner portion between adjacent apertures of the set and at least one outer portion adjacent each aperture at the end of the line extending away from the respective inner portion, whereby in use, a sample tube is passed through the apertures of a set so that the at least one of the inner portion lies to one side of the sample tube and adjacent portions lie on the other side of the sample tube, thereby sandwiching the sample tube between the portions.

The length dimension may between about 1.1 and about 5.00 times greater than the width dimension and more preferably between about 1.2 and about 2.0 times greater than the width dimension. Most preferably the length dimension is about 1.25 times greater than the width dimension.

The sample tube holder may be for use with a range of sample tubes having diameters between $D_1$ and $D_2$, where $D_1<D_2$ and the width dimension may be between about $D_1\times1.05$ and about $D_1\times0.45$. The length dimension may be between about $D_2\times1.7$ and about $D_2\times0.95$.

The width dimension is preferably between about $D_1+5\%$ and about $D_1-5\%$.

The length dimension is preferably between about $D_2+5\%$ and about $D_2-5\%$.

In the preferred forms of the invention each opening is defined by at least one arc but is non circular, i.e. all perpendiculars to the perimeter will not intersect at a single point.

The perimeter of each opening may include a straight portion and an arc portion.

More preferably the perimeter of each opening includes two opposed arcs. The arcs are preferably arcs of a circle, i.e. of constant radius and are each centred on a centre point opposite the centreline of the opening.

Each opening may be an oval or an ellipse or oval like or ellipse like. It will be appreciated that due to manufacturing and other limitations or requirements the actual perimeter may have a minimum radius of curvature. For example, two opposed arcs will intersect at a point, which will be converted to a small radius curve.

In the preferred form of the invention, the holder has mounting means to mount or attach the holder to a blood collection bag or the like. Preferably the mounting means is located at opposed longitudinal free ends of the holder. Preferably the mounting means are configured to mount the holder vertically to a collection bag and more preferably engage the tubing that is intrinsically part of the blood bag (hereinafter called integral tubing) at one end of the blood collection bag and the base of the bag at the other end. The mounting means may also be used to attach the holder to another item at the collection site, at the end user's discretion.

In a preferred form, the mounting means comprises one or more hooks at one end of the holder for engaging the integral tubing at one end of the blood collection bag and an arrow or T-shaped head at the other end of the holder for engaging in an aperture in a peripheral wall at the base of the blood collection bag. The mounting means may include a closed or substantially closed aperture that an integral tube for the blood collection bag passes through. The mounting means may include a tab with a closed aperture sized so that the holder may be wrapped around an object, such as a tube or part of a blood bag and passed through the aperture to secure the holder to the object.

The holder may be formed integrally with another object or attached thereto, such as a blood bag. Accordingly the invention also includes a bag for collection of fluid having a generally flat elongate flexible body attached or connected thereto, the body having one or more of sets of apertures in the body. Each set has two or more apertures arranged in a line. Each set of apertures defines at least one inner portion between adjacent apertures of the set and at least one outer portion adjacent each aperture at the end of the line extending away from the respective inner portion. In use, a sample tube is passed through the apertures so that the at least one of the inner portion lies to one side of the sample tube and adjacent portions lie on the other side of the sample tube, thereby sandwiching the sample tube between the portions The holder may have a generally elongate central portion adapted to hold sample tubes and a tab extending longitudinally from at least one end. Preferably the tab is configured to engage the other end of the holder. The tab may also have a label/writing area for placement of information thereon.

Preferably the other end also has a longitudinally extending tab. preferably the two tabs are configured so that they may be joined together. Preferably one of the tabs is configured so that it may be wrapped around an object and connected to itself.

Unless the context clearly requires otherwise, throughout the description and any claims the words 'comprise', 'comprising', and the like are to be construed in an inclusive sense as opposed to an exclusive or exhaustive sense; that is to say, in the sense of "including, but not limited to".

These and other features of the invention shall be apparent from the attached drawings and a description of a preferred non limiting form of the invention.

DETAILED DESCRIPTION OF PREFERRED EMBODIMENTS

Figure 3:
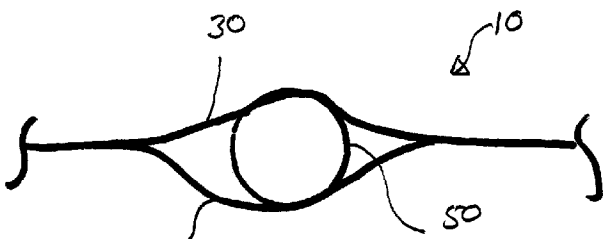
FIG. 3 is a side view of a portion the holder and tubes of FIG. 2.
Figure 2:
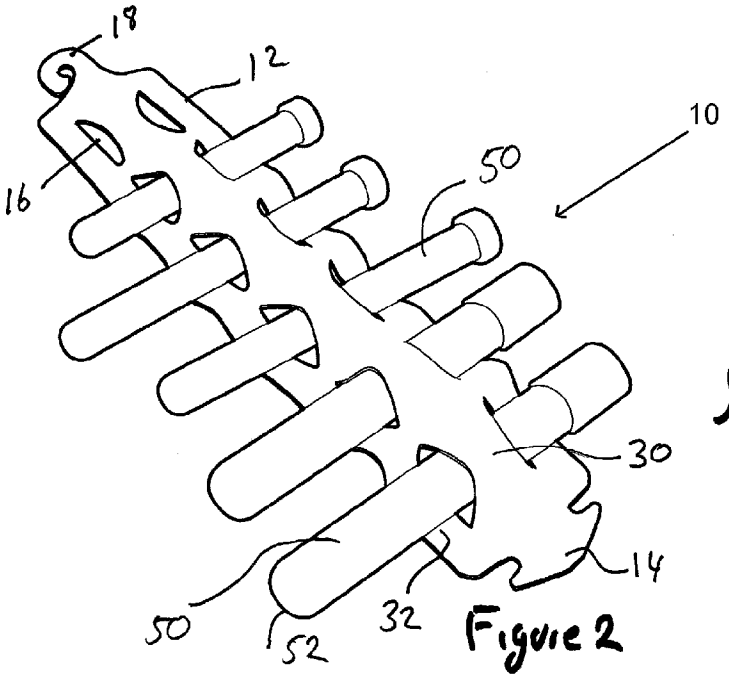
FIG. 2 is a perspective view from above showing the holder of FIG. 1 in use holding a number of sample tubes of various sizes.
Figure 1:
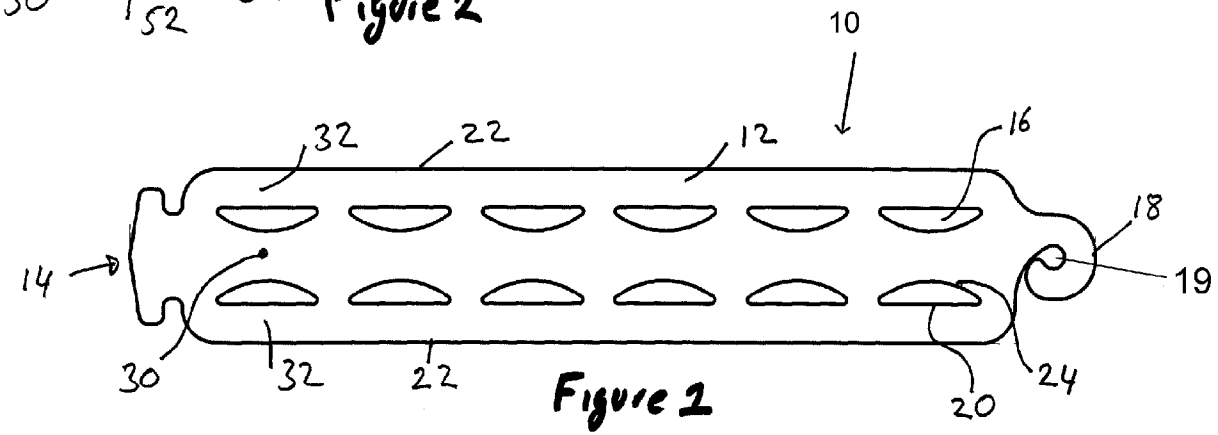
FIG. 1 is a plan view from above of a holder according to a first embodiment of the invention.

Referring to FIGS. 1 to 3 there is shown a sample tube holder 10 according to a first embodiment of the invention. The sample tube holder 10 is generally elongate and is formed of a layer or layers of flexible and resilient plastics, rubber, synthetic rubber or similar material.

The sample tube holder 10 is designed to be attached to a conventional blood collection bag. Such bags have an upper end with integral tubing extending generally centrally and a base with one or more slits in a peripheral wall. Accordingly, the sample tube holder 10 has a generally rectangular portion 12 with an arrow or T-shaped head 14 at one end, designed to engage in one of the slits in the base of a conventional blood bag and a hook 18 at its other end for connection about the integral tubing extending from the other end. Although the hook 18 defines a substantially closed opening 19, because it is formed of flexible material the hook 18 may be opened to wrap around the tube.

Extending along the rectangular portion 12 of the holder is a set of pairs of apertures 16. Both apertures of a pair are substantially identical and, in this embodiment, each is in the form of a segment of a circle. The straight line 20 of each segment extends generally parallel to the edges 22 of rectangular portion 12 and with the arc 24 located inwards of the straight edge 20.

Each aperture 16 is about 26.5 mm long and has a width of about 6.0 mm. The ends of the aperture, where the arc 24 and straight edge 20 join, preferably have a joining portion of small radius, typically about 1.0 mm. The length of each aperture is thus about 4.5 times its width.

Each pair of apertures 16 thus defines a central portion 30 located between the two apertures and two outer portions 32, between the apertures and the edges 22 of the rectangular portion 12.

As best seen in FIG. 2, it is possible to insert a sample tube 50 through the apertures 16, so that the central portion 30 lies to one side of the sample tube 50 and the outer portions 32 lie on the other side of the sample tube 50. Since the material of the holder is flexible and resilient, it holds the tube 50 in place. Further tubes of different sizes are readily accommodated, as seen in FIG. 2.

Insertion of a sample tube 50 into the holder 10 is relatively simple. The user merely pushes the rounded free end 52 of the tube 50 into one of the apertures 16 and then threads it through the other aperture of the pair.

Because the material of the holder is flexible and resilient, it distorts and/or stretches to accommodate the tube and resists sideways movement of the sample tube 50 across the rectangular portion 12. Preferably the tube is generally centred on the holder, as seen in FIG. 2, but it is merely necessary to pass enough of the tube through the holder that slight sideways movement will not result in the free end 52 disengaging from one of the apertures. Even if this occurs, the engagement of the tube in the other aperture will tend to hold the tube in the holder.

It has been found that with these dimensions sample tubes ranging in diameters from about 12.4 mm to about 15.6 mm may be both easily inserted into the apertures and retained securely.

The holder 10 may be formed of various materials. As examples, the holder may be formed of polypropylene, which is relatively stiff and has relatively little elasticity or may be formed of high density polyethylene, which is "softer" to the touch and has more elasticity.

The advantage of the holder 10 compared to other systems is that all tubes are held together on a single holder and are unlikely to be separated, due to the resilient nature of the material of the holder 10. The holder may be easily attached to or detached from a blood collection bag, using the arrow head 14 and the hook 18, so aiding in maintaining the donated blood and its samples together.

The holder 10 also enables easy collection of the sample tubes. As the user fills each sample tube 50 with blood it may be inserted into the holder and retained whilst the user fills the next sample tube 50 before inserting that next tube into the holder 10. Further, the holder 10 may be used to hold the sample tubes 50 before use and during collection. In this scenario, an end user organization will supply the sample tubes 50 already mounted on the holder as per FIG. 2, and a user merely needs to sequentially fill each sample tube on the holder. This may be done without removing the tubes from the holder, aiding in facilitating that the required samples are collected.

The flexibility and resilience of the holder material likewise permits the holder to be twisted along its longitudinal axis. This flexibility permits sample tubes loaded into apertures at one end of the holder to be agitated, while sample tubes held in apertures at the opposite end can be held still concurrently.

Assuming the holder 10 is on a relatively horizontal surface, neither the holder 10 nor any attached sample tubes 50 will roll or fall off that surface. The holder 10 thus also aids in limiting accidental destruction of tubes through dropping, or the like, before or after collection of the blood samples.

It should be understood that not all pairs of apertures 16 need to be filled by an end user organisation. Thus a holder 10 with a capacity of six sample tubes may be filled by an end user organisation with only five sample tubes, or left empty but with instructions to only take five samples. While the number of pairs of apertures 16 on a given holder 10 will be fixed, an end user organisation retains flexibility to only fill the holder with the number of tubes required by its own processes.

In this embodiment there are six pairs of apertures 16 and all are identical to each other. It is not essential that all apertures be identical and, if desired, the apertures may be sized differently. The holder may have more or less than six pairs of apertures 16. The apertures 16 need not be segments of a circle and may be a simple slit in the material of the holder or may be of other shapes, such as a narrow rectangle, with the long side of the rectangle parallel to the edges 30 of the central portion. The apertures 16 need not be in a straight line and may be stepped down or up to each other, along the long side of the rectangle parallel to the edges 30 of the central portion and outer portions 32. Other configurations are within the scope of the invention.

In effect, what is important is the provision for each tube of two passageways, a central portion between the passageways and two outer portions, with each passageway sandwiched between the central portion and an outer portion.

The use of an arrow head 14 and hook 18 to retain the holder 10 onto the bag during transport is not essential and other means to secure the holder to the bag may be used. It is not critical that the holder 10 attach or mount on a part of the bag. As an example, the holder may be wrapped around the bag with the free ends of the holder secured to each other to retain the holder on the bag.

Figure 4:
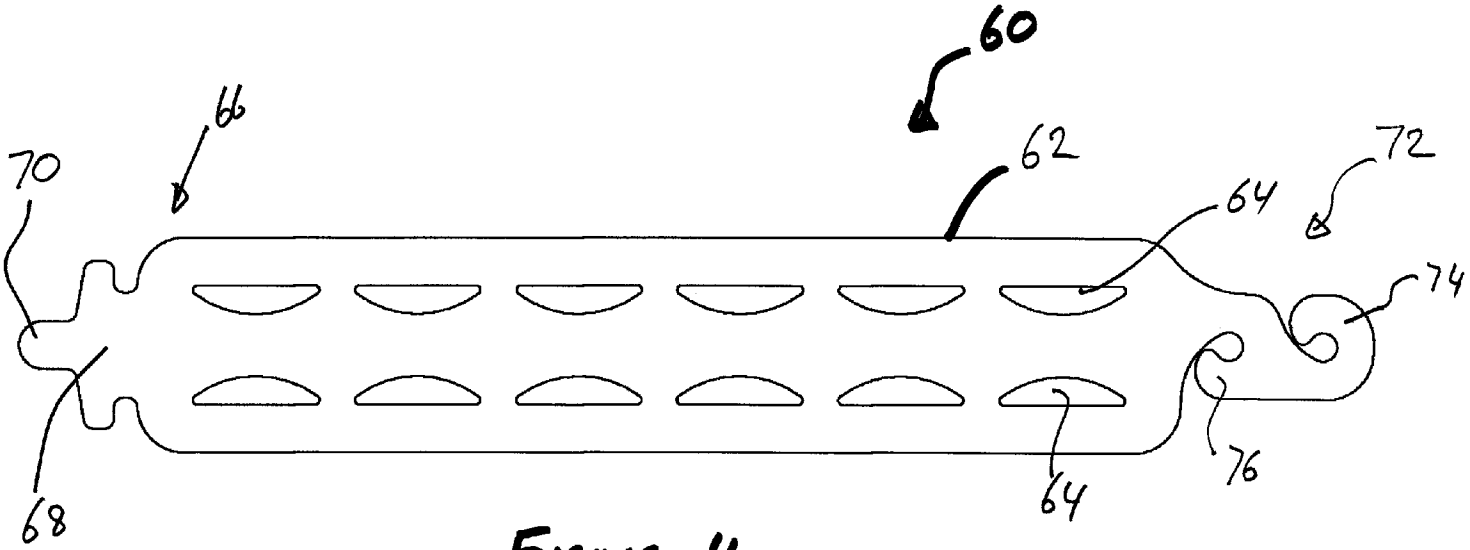
FIG. 4 is a plan view from above of a holder according to a second embodiment of the invention.

FIG. 4 shows a sample tube holder 60 according to a second embodiment of the invention. This embodiment has a rectangular central portion 62 substantially the same as that of the first embodiment and has six pairs of apertures 64 the same apertures 16 of the first embodiment. The use with, and retention of, sample tubes in the central portion 62 is substantially the same as previously described.

Where the holder 60 differs is in the configuration of the mounting means at each end of the rectangular portion 62.

One end 66 has an arrow or T-shaped head 68. The head has a protrusion or tag 70. This aids the user in pulling the head through a slit in a blood bag or the like.

The other end 72 is provided with two hooks, 74 & 76. One or both of these hooks may be attached to the integral tubing of the blood bag. Use of both hooks 74, 76 creates a tighter hold on the integral tubing and also increases the security of the attachment—if one of the hooks is not correctly engaged with the integral tubing the holder 60 will still be secured to the blood bag at both of the holder's ends.

Figure 5:
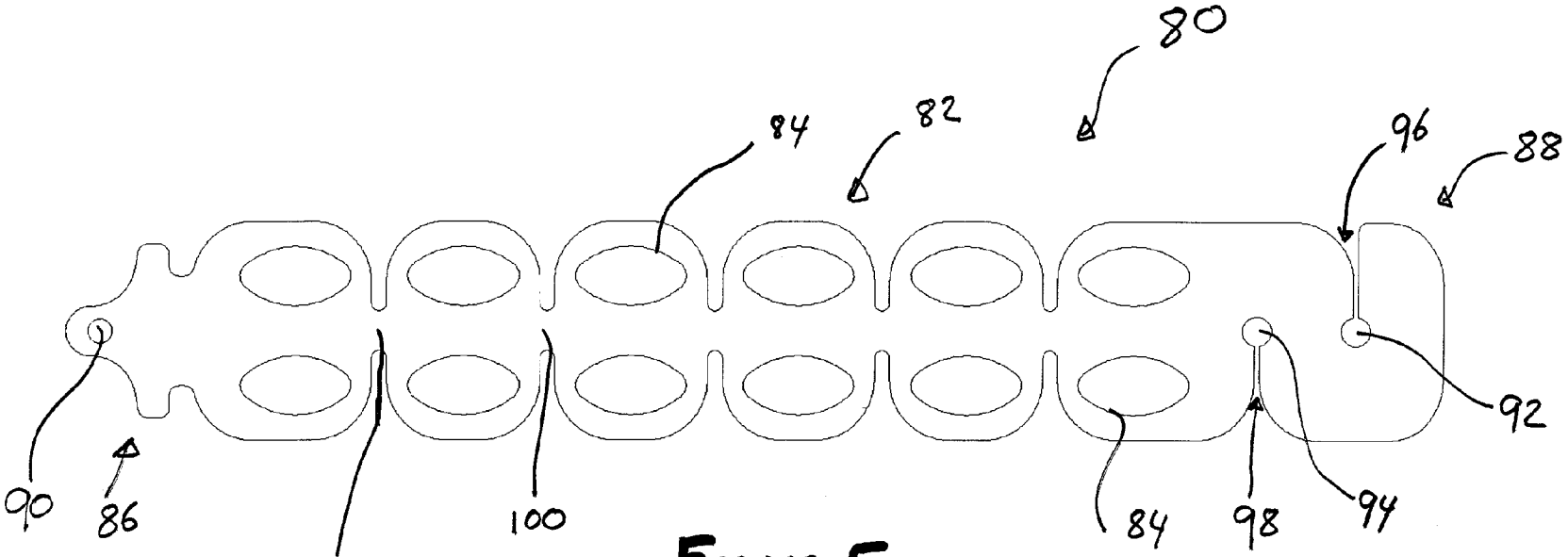
FIG. 5 is a plan view from above of a holder according to a third embodiment of the invention.

FIG. 5 shows a sample tube holder 80 according to a third embodiment of the invention.

The holder 80 functions similarly to that of the earlier embodiments and has an elongate central portion 82 with six pairs of apertures 84 running along its length. An arrow or T-shaped head portion 86 is located at one end and a double hook like portion 88 is located at the other end.

The T-shaped head portion 86 has an aperture 90. The double hook like portion 88 has two passageways 92, 94 for receiving the integral tubing. These passageways 92, 94 are almost closed and have narrow slits 96, 98 extending in opposite directions. The double hook like portion 88 may be attached to the integral tubing by twisting the material on either side of a slit so as to open the slit and allow the integral tubing to slide into the opening. This configuration substantially reduces the risk of accidental detachment from the integral tubing.

The central portion 82 is divided into six segments, each of which has a single pair of apertures 84. The number of segments may be more or less than six. Adjoining segments are connected to each other by a narrow section of material 100. The narrowness of this section 100 allows adjacent segments to be rotated relative to each other about a longitudinal axis. Thus, one or more sample tubes mounted on the holder 80 may be agitated by such rotation whilst other sample tubes mounted on the holder 80 remain or are held static or substantially static.

Whilst it is preferred that each sample tube mounted on the holder 80 may be agitated independently or substantially independently of other sample tubes, if desired each segment may have two or more pairs of apertures.

The apertures 84 are oval but may be of the shape shown for the first two embodiments or other appropriate shapes.

In the example of FIG. 5 the holder is made of polypropylene and each oval aperture 84 is defined by opposed arcs having a radius of about 16.0 mm joined by curved sections having a small radius of 3.0 mm. The apertures are typically about 22.6 mm long and about 12 mm wide. The length of each aperture is thus about 1.9 times its width.

It has been found that with these dimensions sample tubes ranging in diameters from about 12.4 mm to about 15.6 mm may be both easily inserted into the apertures and retained securely.

Figure 6:
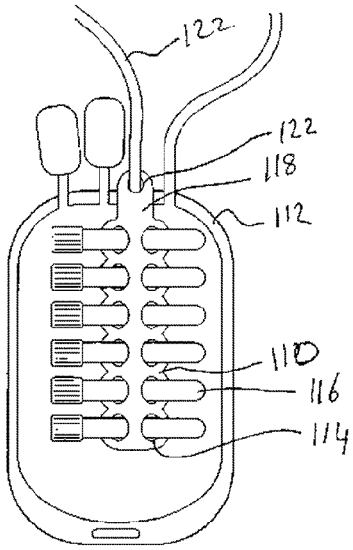
FIG. 6 is a side view of blood bag with a holder according to a fourth embodiment of the invention.

FIG. 6 shows a holder 110 that is attached to a blood bag 112. The holder 110 has a series of sets of pairs of apertures 114 in which sample tubes or vials 116 are located. As explained with reference to FIG. 17, each set may have more than two apertures.

The holder 110 has a tab 118 with a closed aperture 120. The holder is mounted on the blood bag during manufacture by passing one of the normal tubes 122 through the aperture 120. The tube 122 will have one or more devices, such as a tube clamp (not shown) attached downstream of the bag 112 that prevent the holder being removed without cutting the tube or the tab 118.

Figure 7:
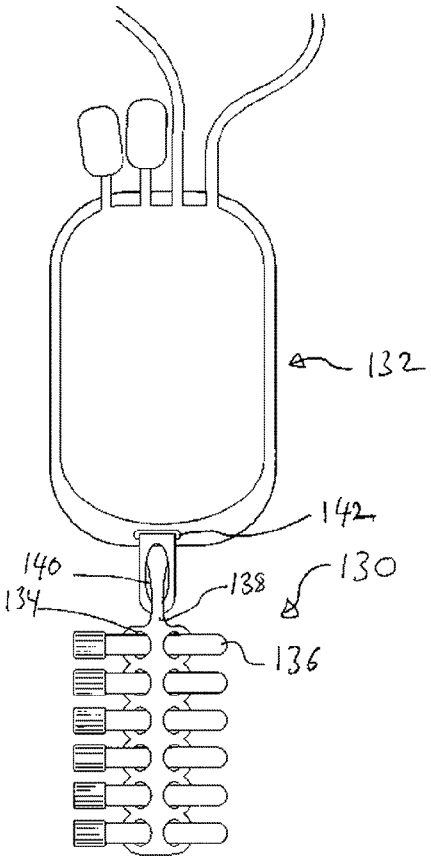
FIG. 7 is a side view of blood bag with a holder according to a fifth embodiment of the invention.

FIG. 7 shows a holder 130 that is attached to a blood bag 132. The holder 130 has a series of sets of pairs of apertures 134 in which sample tubes or vials 136 are located.

The holder has a tab 138 that has an aperture 140. The tab passes through a slit or aperture 142 in the peripheral portion of the bag 132. The main body of the holder has been passed through the aperture 140 to secure the holder 130 to the bag 132. Separation of the holder when empty is unlikely. Further, when one of sample tubes 136 is mounted on the holder they must be removed first before the holder can be removed from the bag. Thus accidental separation is unlikely.

Figure 8:
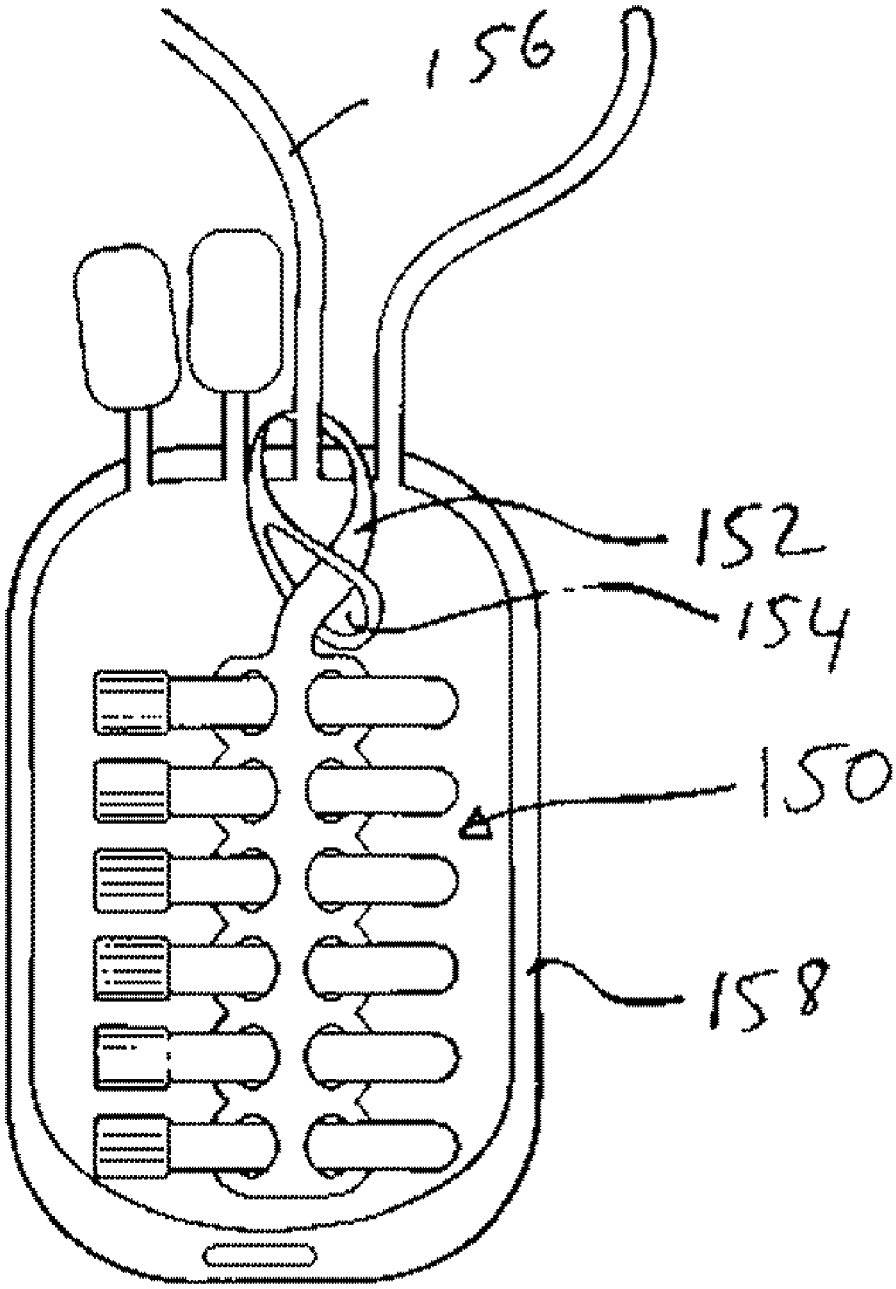
FIG. 8 is a side view of blood bag with a holder according to a sixth embodiment of the invention.

FIG. 8 shows a holder 150 similar to that of FIG. 7, having tab 152 and aperture 154. The tab extends around tube 156 of bag 158. The main body of the holder has been passed through the aperture 154 to secure the holder 150 to the tube.

Figure 9:
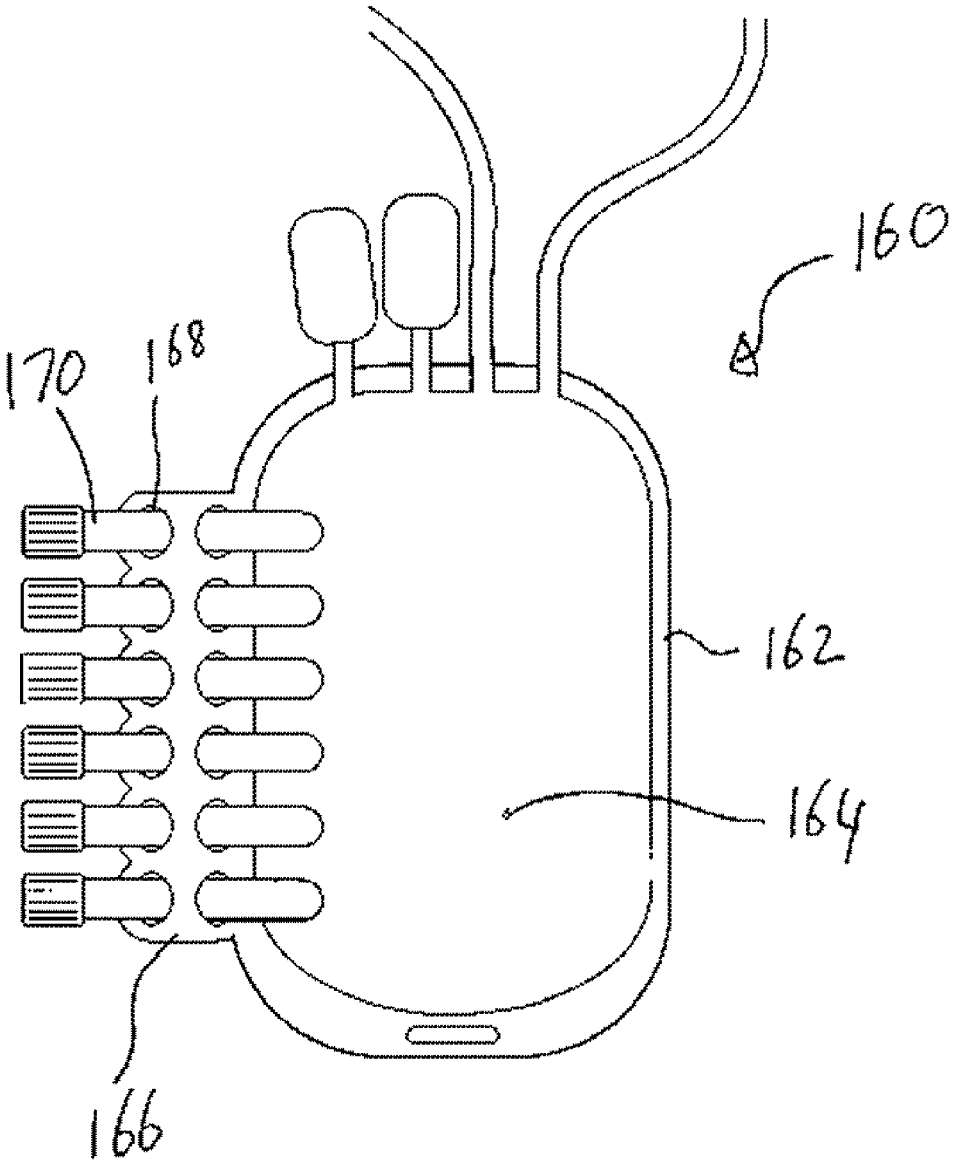
FIG. 9 is a side view of blood bag with an integral holder according to a seventh embodiment of the invention.

FIG. 9 shows a combined blood bag and holder 160. Blood bags are typically formed of two sheets of material joined to define a substantially closed volume 164 therebetween. In this embodiment one (or both) of the sheets extends to one side of the volume so as to define a tab 166 having a series of sets of apertures 168 in which sample tubes 170 are secured.

Figure 10:
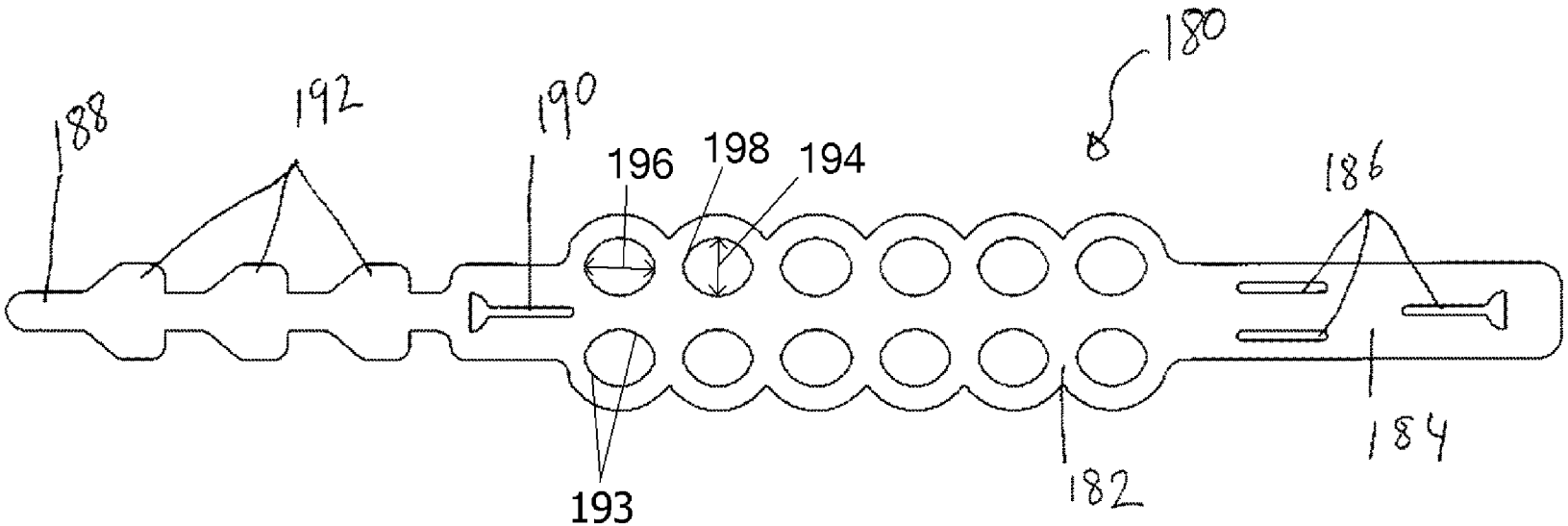
FIG. 10 is a side view of a holder according to an eighth embodiment of the invention.

FIG. 10 shows a holder 180 similar to that of FIGS. 1 to 3 except that the central body 182 has a first tab 184 at one end with apertures 186. The other end has a second tab 188 that has an aperture 190 and enlarged portions 192. The holder may be attached around a tube, such as a blood bag tube and passing one or more of the enlarged portions 192 through aperture 190. Alternatively the holder may be wrapped around an object, such as a blood bag itself and one or more of the enlarged portions 192 passed through one or more of the apertures 186 on the other tab 184.

The apertures in the holder 180 are oval and are formed of two opposed arcs 193. These arcs are of a constant radius of about 7.8 mm and subtend an angle of about 150 degrees, giving a length 196 along the holder of about 15 mm. The ends of the two ores are joined by a small radius curve 198 of about 3 mm diameter and so the aperture is an oval. The centre point of each arc is not located on the centreline but is located approximately 1.8 mm on the other side of the centreline. The width 194 of the aperture across the holder is thus about 12.0 mm. The length is thus about 125% of the width.

It has been found that with these dimensions sample tubes ranging in diameters from about 12.4 mm to about 15.6 mm may be both easily inserted into the apertures and retained securely.

The material of the holder is preferably medical grade high density polyethylene. The high density polyethylene is more elastic than, for instance, polypropylene and this is a factor on the size and shape of the holes. For materials that are not elastic the holder does not stretch and the holes need to be proportionately longer and thinner than those used in material that is elastic. Thus, generally, a material such as polypropylene that is relatively inelastic will have hole shapes similar to those in FIGS. 1 to 5 whilst a more elastic material, such as polyethylene, will have a hole shapes similar to those of FIG. 10.

Figure 12:
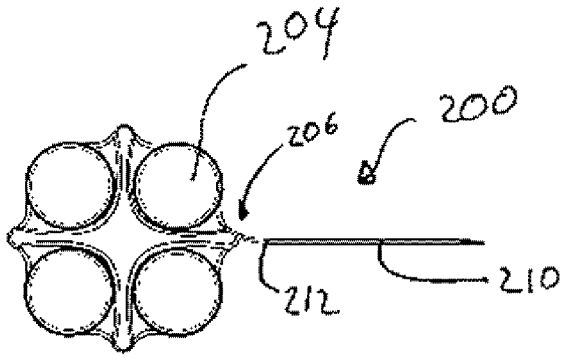
FIG. 12 is a plan view of the holder of FIG. 11.
Figure 11:
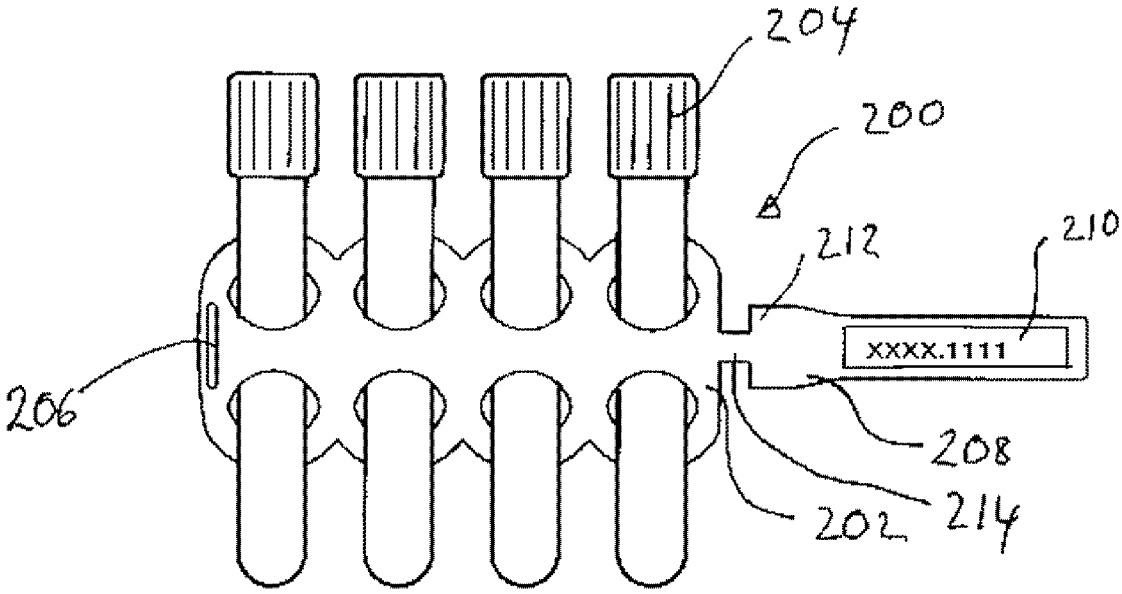
FIG. 11 is a side view of a holder according to a ninth embodiment of the invention.

FIGS. 11 and 12 show a holder 200 with a central portion 202 for holding sample tubes 204. One end of the central portion 202 has a slit or aperture 206. The other end has a tab 208 having label portion 210, to which a label or writing may be applied, an enlarged portion 212 and a narrow portion 214. The enlarged portion 212 has a width greater than the slit 206. In use the holder is roller or wrapped around itself, as in FIG. 12 and the tab 208 passed through slit 206 until enlarged portion has passed through slit 206, thus retaining the tab in the slit 206.

Figure 14:
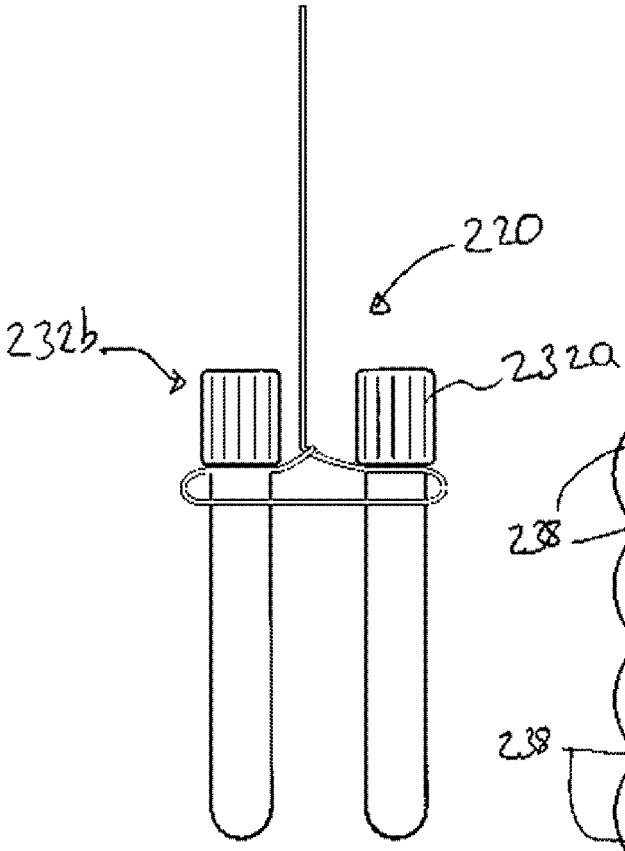
FIG. 14 is a side view of the holder of FIG. 13.
Figure 13:
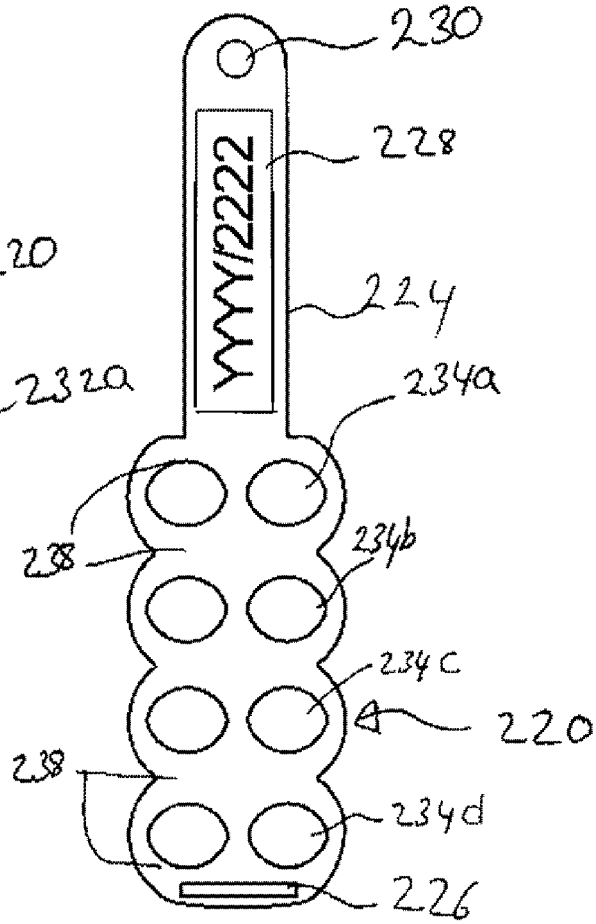
FIG. 13 is a plan view of a holder according to a tenth embodiment of the invention.

FIGS. 13 and 14 show a holder 220 having a central body 222 with tab 224 at one end and slit 226 at the other end. The tab 224 has label/writing area 228 and aperture 230. In this embodiment the sample tubes 232 may be stored crosswise, as in the other embodiments or, as shown in FIG. 14, lengthways. Thus test tube 232*a* will pass through aperture 234*a* & 234*b* whilst tube 232*b* will pass through apertures 234*c* & 234*d*. Prior to tab 224 being passed through slit 226 the portions 238 on either side of each aperture will retain the sample tubes. The aperture 230 may be used to hang the holder and tubes.

Figure 16:
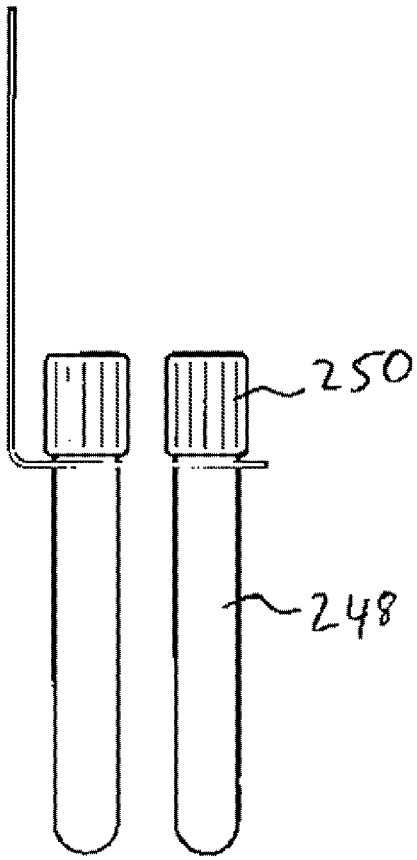
FIG. 16 is a side view of the holder of FIG. 15.
Figure 15:
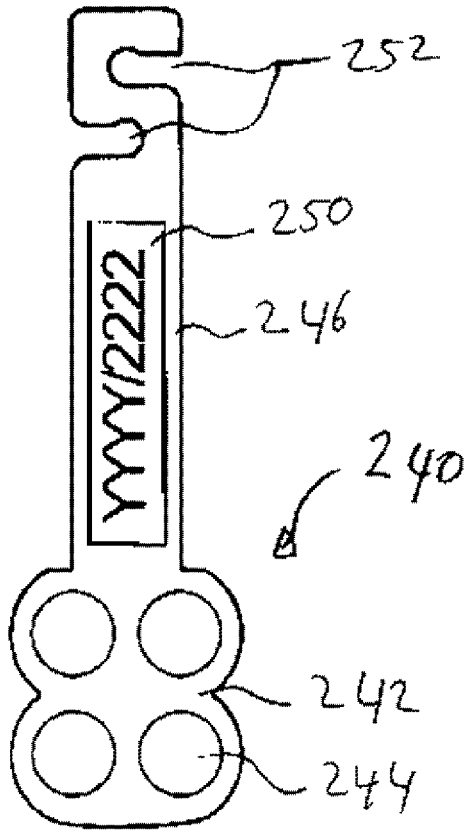
FIG. 15 is a plan view of a holder according to an eleventh embodiment of the invention.

FIGS. 15 and 16 show a holder 240 comprising a body 242 with four apertures 244 and a tab 246. The body holds four sample tubes 248 that are each merely inserted through one of the apertures 244 with the bung or cap 250 engaging the body 242. The tab 246 includes label portion 250 and recesses 252 that extend inwards from either sides, enabling the tab to engage a tube or the like.

Figure 17:
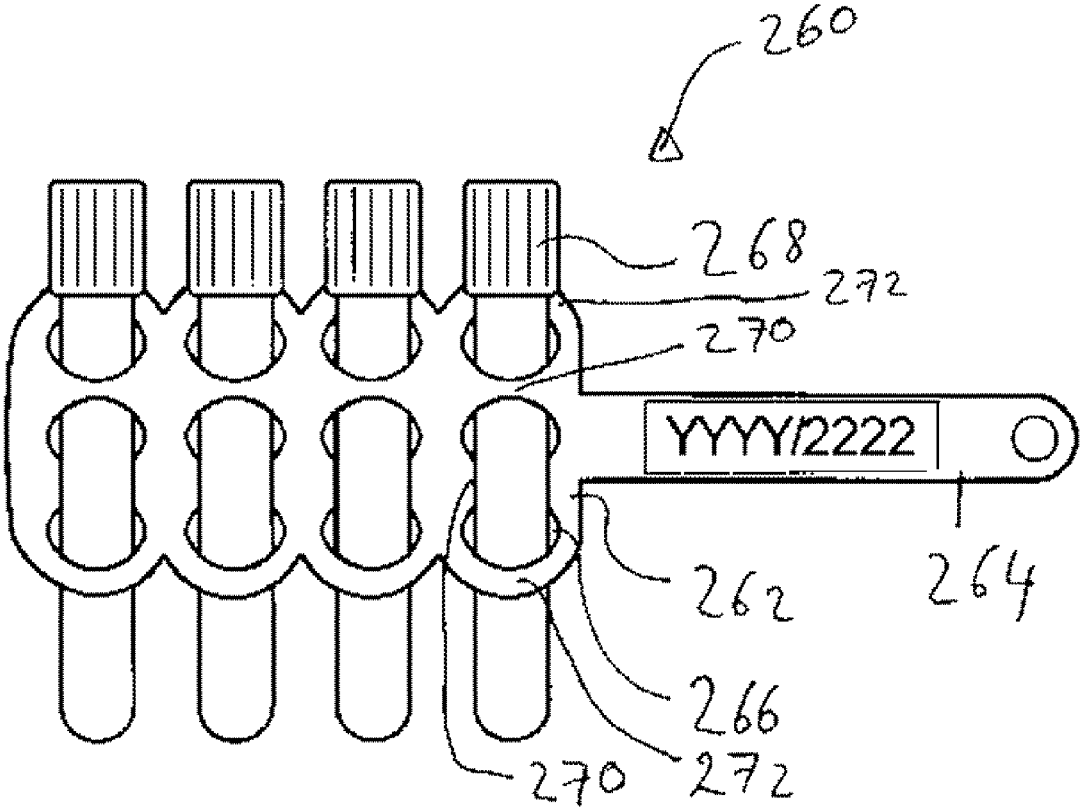
FIG. 17 is a side view of a holder according to a twelfth embodiment of the invention.

FIG. 17 shows a holder 260 having body 262 and tab 264. The body 262 has a number of sets of apertures 266. Each set has three apertures and each test tube 268 is passed through the apertures so the inner portions 270 between adjacent apertures lie on opposite sides of the respective tube and each inner portion is on the opposite side of the tube from the respective adjacent outer portion 272 of the body. The tubes need not be inserted so all have the outer portions 272 on the same side as shown in the figure.

It will be apparent to those skilled in the art that many obvious modifications and variations may be made to the embodiments described herein without departing from the spirit or scope of the invention.

The invention claimed is:

1. A sample tube holder adapted to hold at least one sample tube, the sample tube holder having a generally flat elongate flexible body and:

one or more of sets of apertures wherein each aperture is an oval defined by two opposed first circular arcs each with a first radius, with centre points of the first circular arcs offset from a lengthwise centre line of the aperture, and with the ends of the first circular arcs being joined by two curved sections, each aperture having a length dimension and a width dimension perpendicular to the length dimension, in the body, each set having two or more apertures arranged in a line such that each set of apertures defines at least one inner portion between adjacent apertures of the set and at least one outer portion adjacent each aperture at the end of the line extending away from the respective inner portion, whereby in use, a sample tube is passed through the apertures of a single set so that the at least one of the inner portion lies to one side of the sample tube and adjacent portions lie on the other side of the sample tube, thereby sandwiching and engaging the sample tube between the portions and holding the sample tube to the sample tube holder.

2. The sample tube holder of claim 1 wherein the length dimension is between about 1.1 and about 5.00 times greater than the width dimension.

3. The sample tube holder of claim 1 wherein the length dimension is between about 1.2 and about 2.0 times greater than the width dimension.

4. The sample tube holder of claim 1 wherein the length dimension is about 1.25 times greater than the width dimension.

5. The sample tube holder of claim 1 for use with a range of sample tubes having diameters between $D_1$ and $D_2$, where $D_1<D_2$ and wherein the width dimension is between about $D_1\times1.05$ and about $D_1\times0.45$.

6. The sample tube holder of claim 1 for use with a range of sample tubes having diameters between $D_1$ and $D_2$, where $D_1<D_2$ and wherein the length dimension is between about $D_2\times1.7$ and about $D_2\times0.95$.

7. The sample tube holder of claim 1 for use with a range of sample tubes having diameters between $D_1$ and $D_2$, where $D_1<D_2$ and wherein the width dimension is between about $D_1$ +5% and about $D_1$ −5%.

8. The sample tube holder of claim 1 for use with a range of sample tubes having diameters between $D_1$ and $D_2$, where $D_1<D_2$ and wherein the length dimension is between about $D_2$ +5% and about $D_2$ −5%.

9. The sample tube holder of claim 1 wherein each aperture is a segment of a circle.

10. The sample tube holder of claim 1 having a generally elongate or rectangular retaining portion having a width and a length and wherein the sets of apertures are arranged so that, in use, each sample tube extends across the width of the retaining portion.

11. The sample tube holder of claim 1 having a generally elongate or rectangular retaining portion having a width and a length and wherein the sets of apertures are arranged so that, in use, each sample tube extends along the length of the retaining portion.

12. The sample tube holder of claim 1 including a mounting member to mount or attach the holder to a blood collection bag.

13. The sample tube holder of claim 12 wherein the mounting member is configured to mount the holder vertically to a collection bag.

14. The sample tube holder of claim 1 formed integrally with a blood bag.

15. A combination of the sample tube holder of claim 1 and a sample tube mounted through a single set of apertures of the sample tube holder.

* * * * *